United States Patent [19]

Lee et al.

[11] Patent Number: 4,541,815

[45] Date of Patent: Sep. 17, 1985

[54] TOY VEHICLE

[75] Inventors: James S. W. Lee, c/o Laff, Whitesel, Conte & Saret, 401 N. Michigan Ave., Suite 2000, Chicago, Ill. 60611; Kwong-Wai Chow, Kowloon, Hong Kong; Alfred T. Y. Lau; Ming-Ngar Chow, both of Hong Kong, Hong Kong

[73] Assignee: James S. W. Lee, Long Island, N.Y.

[21] Appl. No.: 569,209

[22] Filed: Jan. 9, 1984

Related U.S. Application Data

[63] Continuation-in-part of Ser. No. 473,991, Mar. 10, 1983, Pat. No. 4,516,945.

[30] Foreign Application Priority Data

Jan. 11, 1983 [GB] United Kingdom ..... 8300589
Dec. 9, 1983 [GB] United Kingdom ..... 8332969

[51] Int. Cl.[4] ..... A63H 29/00
[52] U.S. Cl. ..... 446/464; 446/461
[58] Field of Search ..... 446/457, 461, 462, 463, 446/464, 465; 185/39

[56] References Cited

U.S. PATENT DOCUMENTS

| | | | |
|---|---|---|---|
| 2,182,529 | 12/1939 | Wyrick | 446/461 |
| 2,735,222 | 2/1956 | Glass | 446/461 |
| 3,798,831 | 3/1974 | Higashi | 446/464 |
| 3,938,278 | 2/1976 | Nakamori | 446/461 |
| 4,077,156 | 3/1978 | Asano | 446/464 |
| 4,241,534 | 12/1980 | Larsson et al. | 446/464 |

*Primary Examiner*—Robert A. Hafer
*Assistant Examiner*—Daniel Nolan
*Attorney, Agent, or Firm*—Laff, Whitesel, Conte & Saret

[57] ABSTRACT

A toy vehicle has a gear box containing a clock spring which is wound by pushing the vehicle backward. A two part toggle-linkage system connects the gear box to the frame. When the clock spring is wound, the resulting spring bias urges the toggle-linkage system to one over center position which locks the gear box in order to preserve the energy stored in the wound spring. When the toggle-linkage system is pressed near its center, it moves over center to another position, which unlocks the gear box and releases the energy stored in the wound spring in order to propel the vehicle. When the vehicle is next moved backward, the toggle-linkage returns to the locked position which once again locks the gear box.

9 Claims, 8 Drawing Figures

TOY VEHICLE

This is a continuation-in-part of our earlier application Ser. No. 473,991, filed Mar. 10, 1983, now U.S. Pat. No. 4,516,945, granted on May 14, 1985.

This invention relates to toy vehicles, and more particularly, to toy vehicles which first store energy by being rolled in a backward direction, and which are then driven forward responsive to a release of the energy which is so stored.

There are toy vehicles which are adapted to store energy when they are rolled backward, in order to wind a spring. Usually, these vehicles are propelled in a forward direction by simply releasing them after they have been rolled backward. Examples of such toy vehicles are found in U.S. Pat. Nos. 4,077,156 (Asano) and 2,182,529 (Wyrick).

In each toy, there is a premium on realism. The more that a child can relate his toys to the "adult" world that he sees about him, the more he enjoys and learns from his play. Thus, a toy vehicle which merely plunges away when released is not always perceived as a vehicle which can be controlled. On the other hand, if a toy must be released by switches, levers, and the like, it is not likely to be perceived as an "adult" vehicle either. Moreover, it may be awkward and difficult for a child to get a finger under or around a small toy vehicle in order to work a lever (or the like) without simultaneously deflecting the vehicle from its path.

Accordingly, there is a need for new and improved vehicles which operate in the described manner, and which are controlled, at a touch. Here, an object is to provide such a controlled vehicle, which has no apparent and unrealistic control levers, switches, or the like.

Another object is to provide a reliable and dependable vehicle of the described type that is self adjusting, so that it does not have to be locked in the energy storage condition and unlocked to release the energy.

In keeping with an aspect of the invention, a toy vehicle has a toggle-linkage system, a spring, and a transmission with a reverse gear controlled by the toggle-linkage system and the spring. Rolling the vehicle backward transmits energy through the transmission and automatically operates the toggle-linkage system to store and lock energy in the spring. Manipulation of the toggle-linkage system unlocks and releases the energy stored in the spring by engaging the reverse gear. Responsive to the release of the energy stored in the spring, the vehicle is propelled in a forward direction.

A preferred embodiment of the invention is seen in the attached drawings, wherein.

Figure 1:
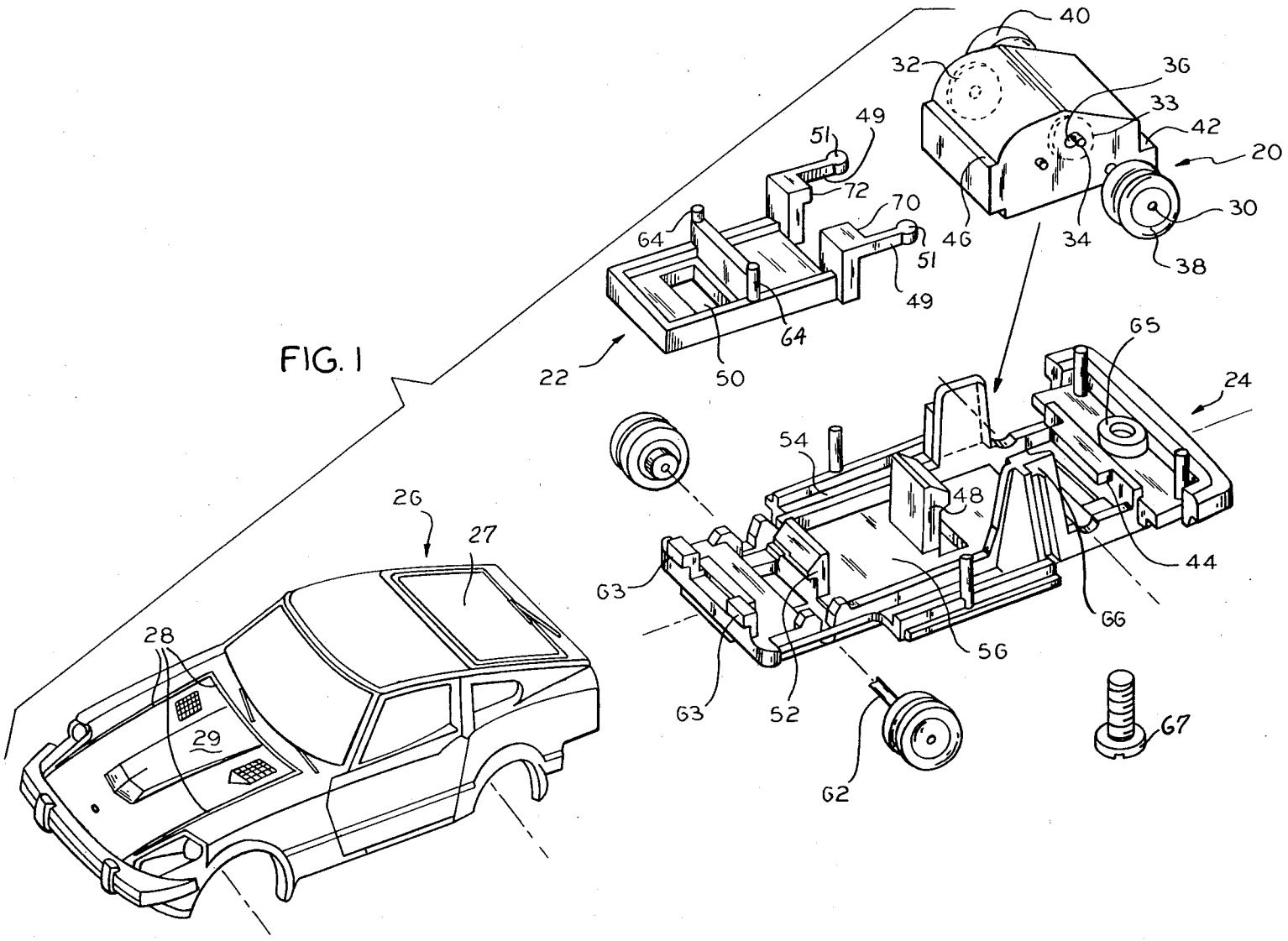
FIG. 1 is an exploded view (in perspective) of the inventive toy vehicle.
Figure 2:
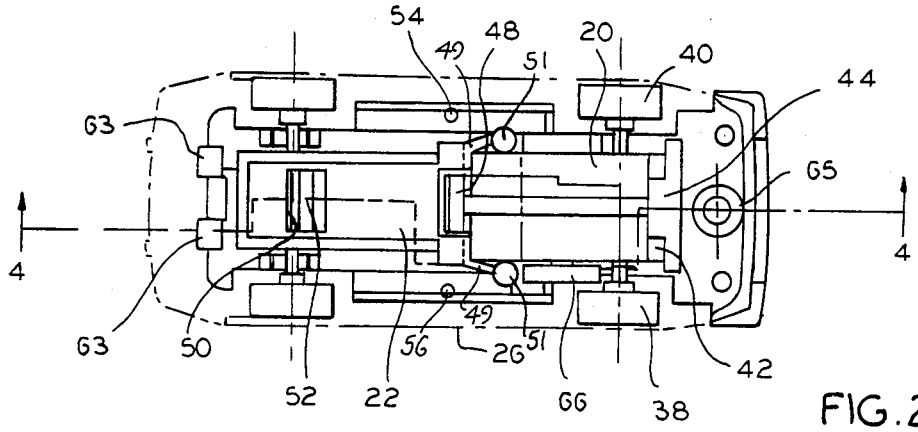
FIG. 2 is a top plan view of the inventive toggle-linkage system mounted on a chassis.
Figure 3:
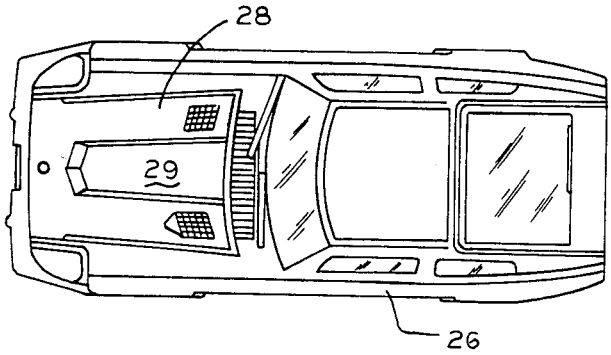
FIG. 3 is a top plan view of the toy vehicle where a body panel or other suitable part (here the hood) is used to release the energy stored in a spring and thereby propel the vehicle.

FIG. 1 includes an exploded view of the major subassemblies of the toy vehicle which are: a gear box 20 and a trigger part 22 which together form the toggle-linkage system, a chassis 24, and a body 26. The body 26 has a hood 29 which is defined by double line 28 to show that it is hinged at the front to provide an energy release control panel.

The gear box 20 may take any suitable form, which, for present purposes, might be viewed as being somewhat similar to the gear box shown in the Asano U.S. Pat. No. 4,077,156 or the Wyrick U.S. Pat. No. 2,182,529. In general, the gear box 20 contains a gear train which extends from an axle 30 to a clock spring 32. A movable pinion gear 33 is mounted on a shaft 34 which is free to move back and forth between the limits set by an elliptical or elongated hole 36. When shaft 34 is in one end (here the upper end) of the hole 36, the gear train is connected to axle 30 and wheels 38, 40 so that the vehicle is driven forward. When shaft 34 is in the other end (here the lower end) of hole 36, the gear train is connected to axle 30 in a manner which winds the spring 32 and stores energy when the vehicle is pushed backward. In short, the gear train is a transmission and the pinion is a reversing gear in that transmission.

Therefore, if the shaft 34 is trapped in one end (here the lower end) of hole 36, the gear train is locked in a spring winding or energy storage position. If shaft 34 is free to move into the other (upper) end of hole 36, the energy of the spring is released to propel the vehicle.

The rear side of gear box 20 has a step 42 which may be captured under a tab 44 integrally formed on the chassis 24. The front side of the gear box 20 also has a step 46 which engages edges 70, 72 on the trigger part 22. Step 46 also engages a limit stop 48, integrally formed on the chassis 24 to limit the upwardly travel of the gear box 20. The trigger part 22 has a pair of arms 49 which embrace the gear box 20 to stabilize the toggle-linkage against lateral movement. The ends of arms 49, 49 terminate in generally cylindrical members 51, 51 which bear upon the sides of the gear box 20 to reduce friction at the point of embrace.

The forward end of trigger part 22 has an aperture 50 which fits over and is held downwardly by a latch 52 integrally formed on chassis 24. There are two upstanding posts 54, 56 which loosely engage the sides of the trigger part 22, in order to help hold it in alignment. Also, the tops of posts 54, 56 engage and help support the bottom of a transparent piecepart which fits inside the body 26 to provide the windows of the car.

Thus, the trigger part 22 is free to move up and down within the limits provided by the floor of chassis 24 and limit stop 48. The remainder of the embossments on chassis 24 are provided for aligning the positions of the body shell 26 and the front axle 62 over the chassis 24. The front of the body shell is captured by hooks 63, after which the back of the body shell fits over a reinforced hole 65 through which a self-tapping screw 67 passes to seize and hold the body.

Figure 5:
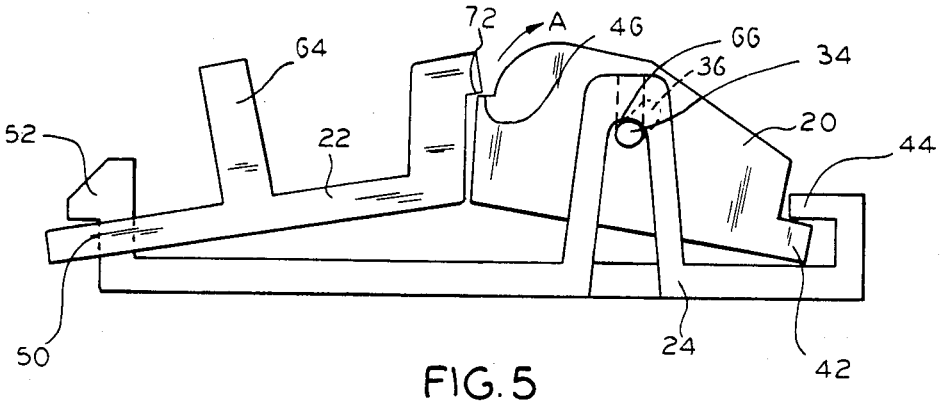
FIG. 5 shows the toggle-linkage in a first over-center position which locks the gear box and the energy stored in a spring.

The trigger part 22 has a pair of upstanding posts 64 integrally formed thereon which raises to a height that slightly raises hood panel 29, when the toggle-linkage is locked in an energy storage condition (see FIG. 5). The height of upstanding posts 64 is such that, the toggle-linkage is pushed down (see FIG. 6) to the energy release condition when a downward pressure is placed on the hood 29. Upstanding ribs are formed on the perimeter of trigger part 22 to give it strength and rigidity.

Figure 4:
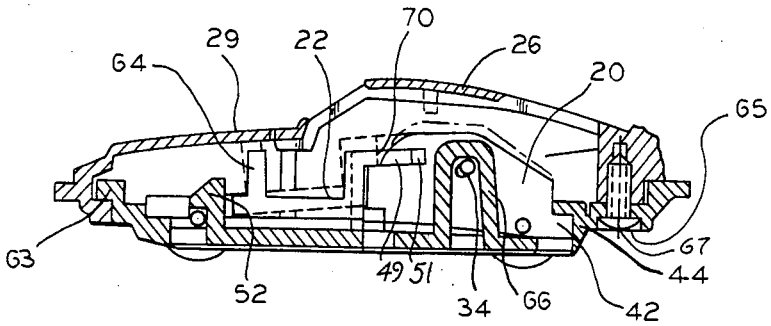
FIG. 4 is a cross-sectional view taken along line 4—4 of FIG. 2 to show the toggle-linkage mounted in the vehicle.

Integrally formed on the chassis 24 is an upstanding power locking bridge means 66 which rises to a level that pulls the shaft 34 into the energy locked position (FIG. 5), against the lower end of slot 36, while the gear box is raised to the level where step 46 bears against limit stop 48. When the gear box 20 is resting against the floor of chassis 24 (FIG. 6), the power locking bridge means 66 allows the shaft 34 to escape to the upper end of the slot 36, which releases the energy stored in the clock spring 32. This gear box response to the toggle action is also seen in FIG. 4 where the lower position of the gear box 20 is shown by solid lines and the raised position is seen by dot-dashed lines.

Figure 6:
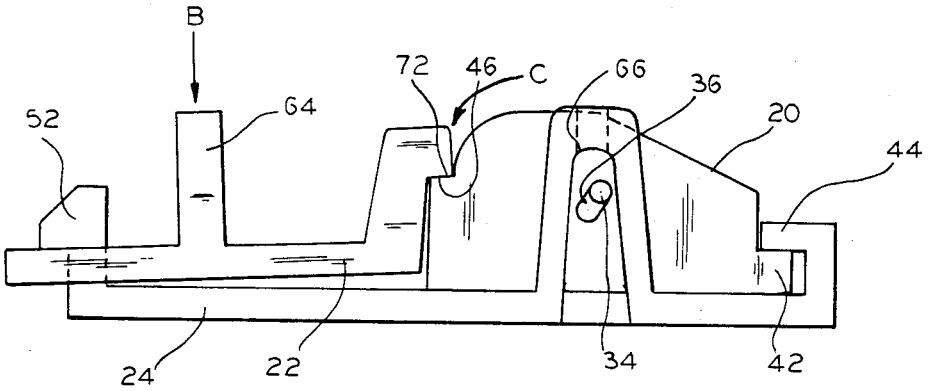
FIG. 6 shows the toggle-linkage in a second over-center position which unlocks the gear box and releases the energy stored in the spring.

In greater detail, FIGS. 5 and 6 show the two over-center positions of the toggle-linkage. One end of the trigger lever 22 is hooked under hook 52 near the front end of the chassis 24. As shown in FIG. 5, the clock spring 32 has been wound by moving the vehicle backward. Therefore, because the vehicle is rolled in a backward direction, tension in the clock spring urges the gear box 20 to tip upwardly in direction A. The tipping occurs because the back step 42 on gear box 20 rocks against a fulcrum formed by the tab 44 on the chassis 24. With the clock spring 32 (FIG. 1) urging the gear box upwardly in direction A (FIG. 5), the shaft 34 is captured in the lower end of slot 36 by a holding means in the form of a locking bridge 66. Thus, the pinion 33 places the gear train in a condition which responds to backward motion in order to wind the clock spring.

To release the energy stored in the clock spring 32, the hood of the automobile is pushed downwardly (FIG. 8), thereby pressing post 64 downwardly in direction B (FIG. 6). As the trigger part 22 moves downwardly in direction B, a pair of its edges 70, 72 press downwardly on step 46 at the front of gear box 20. The gear box rocks in direction C.

As the gear box 20 is moved downwardly, locking bridge 66 which is at a level which is above the upper end of the slot 36, allows the pinion gear on shaft 34 to move upwardly. This pinion gear movement shifts the gears and enables the gear train in box 20 to be driven in a direction which is reversed to the direction in which the gear train moves when the vehicle is rolled backward. That reverse gear train movement is under the urging of the clock spring 32. Also, the release of the clock spring, through the gear train, relieves the bias which caused the toggle-linkage to move over center, as shown in FIG. 5.

When the clock spring runs down and loses its stored energy, the toggle-linkage remains in the energy release condition seen in FIG. 6.

When the vehicle is next rolled backward, energy is again stored in the clock spring 32. The toggle-linkage returns to the cocked position of FIG. 5. The gear train is again locked by the capture of the pinion shaft at the lower end of slot 36, until part 64 is next pushed in direction B (FIG. 7).

Figure 7:
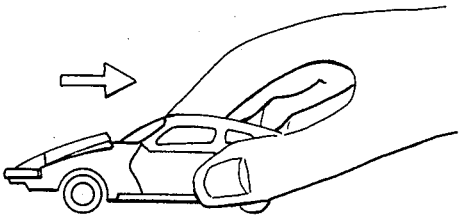
FIG. 7 shows the toy vehicle being rolled backward, to store energy.
Figure 8:
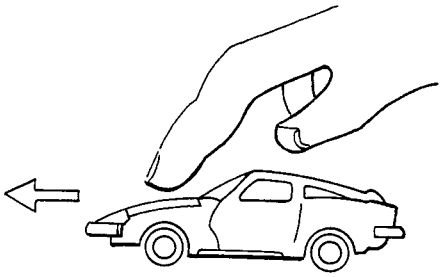
FIG. 8 shows the release of energy stored in the vehicle by a touch upon the hood.

The operating sequence is seen in FIGS. 7, 8. The vehicle is rolled backward as seen in FIG. 7, and the hood pops up. Then, the vehicle may be left indefinitely in the wound up condition. When the child wants the vehicle to run forward, he pushes down on hood 29 (FIG. 8). That flips the toggle-linkage from the FIG. 5 position to the FIG. 6 position, and the vehicle moves forward under the urging of the clock spring 32.

There are many subtle advantages in the inventive vehicle. A toy vehicle which can be controlled without switches, levers or the like enhances the realism of the toy and a child's play with the toy. In the present invention, for example, as shown in FIG. 4, the toggle linkage moves from the position shown in dot-dashed lines to the position shown in solid lines without the need for any switches or levers. Rather, the hard top 26 can be pressed down to move the toggle linkage from the dot-dashed line position to the solid line position. A clicking noise will result from the downward movement of the toggle linkage. Thus, a child may press on the roof until he/she hears a click "to charge the car", pull back to wind up the motor, and then press the hood to release the energy. This play action puts a premium on realism and provides a reliable and dependable toy vehicle.

Those who are skilled in the art will readily perceive how to modify the invention. Therefore, the appended claims are to be construed to cover all equivalent structures which fall within the true scope and spirit of the invention.

The claimed invention is:

1. A toy vehicle having a gear box including a housing containing a spring, means responsive to backward motion of said vehicle for operation said gear box to store energy in said spring during a first mode of operation, means responsive to a selection of a second mode of operation for releasing the energy stored in said spring through said gear box for driving said vehicle in a forward direction, said gear box winding said spring responsive to a rotation of gears in a first direction when operating said first mode and for rotating said gears in a second direction when operating in said second mode, said invention being characterized by a toggle linkage means comprising said housing of said gear box having one end pivotally attached to said toy vehicle at one point and a trigger lever arm having one end pivotally attached to said toy vehicle at a point which is remote from the one point, a second end of said gear box housing engaging another end of said trigger lever arm to form an over center toggle linkage means, the relative lengths of said gear box housing and said trigger lever arm being such that said toggle linkage moves back and forth between two over-center positions, said spring urging said toggle linkage to one of said two over-center positions when operating in said first mode and a manual selection means moving said toggle linkage to the other of said two over-center positions for operating in said second mode.

2. The toy vehicle of claim 1 further characterized in that said gear box contains a movable pinion gear which reverses the effective rotational direction of said gear box, and means responsive to movement of the toggle-linkage between said over center positions for moving said pinion gear.

3. The toy vehicle of claim 2 further characterized in that holding means are integrally formed on said vehicle for controlling said movement of said pinion gear responsive to the movement of said toggle-linkage between said two over center positions.

4. The toy vehicle of claim 3 further characterized in that the holding means is in the form of a locking bridge above said pinion gear, to hold said gear in a lower position when said toggle-linkage is in an upper position.

5. The toy of claim 3 further characterized in that hinged body panel means are provided on said vehicle, said means for applying a force to said toggle-linkage being operated responsive to movement of said body panel.

6. A toy wheeled vehicle comprising spring menas, transmission means with a reverse gear means responsive to rolling said vehicle backward for transmitting energy through said transmission for storing and locking energy in said spring, the invention being characterized by toggle-linkage means, spring tension caused by said energy stored in said spring urging said toggle-linkage to an operated position, means responsive to a manipulation of said toggle-linkage from said operated position for unlocking and releasing said energy stored in said spring by engaging said reverse gear, and means responsive to said release of said energy stored in said spring for propelling said vehicle in a forward direction.

7. The toy of claim 6 further characterized in that menas integrally are formed on said vehicle in a position relative to the position of said toggle-linkage in said operated position for urging said reversing gear to an energy storage position responsive to said backward rolling of said vehicle.

8. The toy of claim 7 further characterized in that said vehicle comprises a body part which moves said toggle-linkage away from said operated position for urging said reversing gear to an energy release position.

9. The toy of claim 8 further characterized in that said body part is a hood of said vehicle.

* * * * *